US008169371B1

(12) United States Patent
Chamberlain et al.

(10) Patent No.: US 8,169,371 B1
(45) Date of Patent: May 1, 2012

(54) METAL PATCH ANTENNA

(75) Inventors: Neil F. Chamberlain, Burbank, CA (US); Richard E. Hodges, Claremont, CA (US); Mark S. Zawadzki, Los Angeles, CA (US)

(73) Assignee: The United States of America, as represented by the Administrator of the National Aeronautics and Space Administrator, Washington, DC (US)

( * ) Notice: Subject to any disclaimer, the term of this patent is extended or adjusted under 35 U.S.C. 154(b) by 407 days.

(21) Appl. No.: 12/541,725

(22) Filed: Aug. 14, 2009

(51) Int. Cl.
*H01Q 1/24* (2006.01)

(52) U.S. Cl. ..... 343/700 MS; 343/846

(58) Field of Classification Search ..... 343/700, 343/846

See application file for complete search history.

(56) References Cited

U.S. PATENT DOCUMENTS

| | | | | | |
|---|---|---|---|---|---|
| 4,367,474 | A * | 1/1983 | Schaubert et al. | ..... | 343/700 MS |
| 4,386,357 | A | 5/1983 | Patton | | |
| 4,410,891 | A | 10/1983 | Schaubert et al. | | |
| 4,546,225 | A | 10/1985 | McCammon | | |
| 4,724,443 | A | 2/1988 | Nysen | | |
| 4,821,041 | A * | 4/1989 | Evans | ..... | 343/700 MS |
| 5,006,859 | A * | 4/1991 | Wong et al. | ..... | 343/700 MS |
| 5,010,349 | A | 4/1991 | Mizuno et al. | | |
| 5,519,406 | A * | 5/1996 | Tsukamoto et al. | ... | 343/700 MS |
| 5,838,282 | A | 11/1998 | Lalezari et al. | | |
| 6,252,553 | B1 * | 6/2001 | Solomon | ..... | 343/700 MS |
| 6,300,906 | B1 * | 10/2001 | Rawnick et al. | ..... | 343/700 MS |
| 6,492,950 | B2 | 12/2002 | Nakano et al. | | |
| 7,079,078 | B2 | 7/2006 | Yuanzhu | | |
| 7,432,862 | B2 | 10/2008 | Heyde | | |
| 2003/0101571 | A1 * | 6/2003 | Cheng et al. | ..... | 29/600 |
| 2006/0220962 | A1 | 10/2006 | d'Hont et al. | | |

* cited by examiner

*Primary Examiner* — Tho G Phan
(74) *Attorney, Agent, or Firm* — Mark Homer

(57) ABSTRACT

Disclosed herein is a patch antenna comprises a planar conductive patch attached to a ground plane by a support member, and a probe connector in electrical communication with the conductive patch arranged to conduct electromagnetic energy to or from the conductive patch, wherein the conductive patch is disposed essentially parallel to the ground plane and is separated from the ground plane by a spacing distance; wherein the support member comprises a plurality of sides disposed about a central axis oriented perpendicular to the conductive patch and the ground plane; wherein the conductive patch is solely supported above the ground plane by the support member; and wherein the support member provides electrical communication between the planer conductive patch and the ground plane.

23 Claims, 8 Drawing Sheets

METAL PATCH ANTENNA

GOVERNMENT RIGHTS

The invention described hereunder was made in the performance of work under a NASA contract, and is subject to the provisions of Public Law #96-517 (35 U.S.C. 202) in which the Contractor has elected not to retain title.

BACKGROUND OF THE INVENTION

The present invention generally relates to patch antennas, and more particularly to an improved patch antenna having improved physical stability and performance.

One known form of antenna, known as a patch antenna, utilizes a planar patch of conductive material disposed parallel to a ground plane and separated therefrom by a dielectric layer. A feed is provided to communicate electromagnetic energy to or from the patch, and a shorting pin shorts the center area of the patch to the ground plane through the dielectric so as to fix the center of the patch at a ground potential. Patch antennas may be inexpensively manufactured and may be readily formed into low cost, light weight phased array antenna systems.

One difficulty with patch antennas is their narrow bandwidth. In patch antennas previously reported, the bandwidth of the antenna may be as narrow as one or two percent of the center frequency of the antenna. Although in theory the bandwidth of the antenna should increase as the dielectric layer separating the patch from the ground plane is increased in thickness, the actual results produced by increasing the dielectric thickness have fallen short of theory. Increasing the dielectric thickness actually further narrowed the bandwidth of the antenna, while also substantially increasing the mismatch between the antenna and the feed, producing inefficient operation.

In addition, by increasing the dielectric thickness from the patch to the ground plane, the stability of the antenna patch decreases.

Operation of the patch antenna in an environment having strong electron fluxes can also be problematic for patch antennas which utilize a dielectric between the patch and the ground plane. Antennas that avoid (or at least minimize) dielectric materials are preferable in such environments (e.g., aboard orbiting spacecraft), however, the dielectric material between the patch and the ground plane is often utilized to support the patch. As such, by minimizing, preferably eliminating the dielectric between the patch and the ground plane, the stability of the patch itself becomes problematic, especially under such extreme conditions as launching a spacecraft.

Dielectric materials utilized in patch antennas may include substrates doped with carbon powder to mitigate against the effects of electron charging. Carbon doping of patch substrate materials is inherently complicated and is expensive to develop and qualify. While carbon-doping in principle prevents static charge build-up, it reduces the strength of adhesives and increases RF losses. Additionally, performance (both electrical and structural) is highly sensitive to material process variations and assembly techniques. Carbon-doping subtly changes the permittivity of materials thus requiring RF characterization of the material in order to design a suitable antenna element.

Another consideration is the relative thermal expansion coefficients of the metal patch and the dielectric material. As the patch expands and contracts at a different rate than the dielectric material, the frequency and other characteristics of the antenna also change and often difficult to predict.

Accordingly, there remains a need for patch antennas which do not suffer from the complications brought on by use of a dielectric material between the patch and the ground plane, and which have the mechanical stability to survive hostile environments including spacecraft liftoff.

SUMMARY OF THE INVENTION

In one aspect of the present invention, a patch antenna comprises a planar conductive patch attached to a ground plane by a support member, and a probe connector in electrical communication with the conductive patch arranged to conduct electromagnetic energy to or from the conductive patch, wherein the conductive patch is disposed essentially parallel to the ground plane and is separated from the ground plane by a spacing distance; wherein the support member comprises a plurality of sides disposed about a central axis oriented perpendicular to the conductive patch and the ground plane; wherein the conductive patch is solely supported above the ground plane by the hollow support member; and wherein the hollow support member provides electrical communication between the planer conductive patch and the ground plane.

In another aspect of the present invention, a patch antenna comprises a planar conductive patch attached to a ground plane by a hollow support member, and a probe connector in electrical communication with the conductive patch arranged to conduct electromagnetic energy to or from the conductive patch; wherein the conductive patch has a patch top face separated from a patch bottom face by a patch thickness, wherein the patch bottom face is disposed essentially parallel to the ground plane and is separated from the ground plane by a spacing distance; wherein the hollow support member comprises a body portion disposed between a patch end and a ground plane end; the body portion comprising a plurality of sides disposed about a central axis oriented perpendicular to the conductive patch and the ground plane, each of the sides having an outer face separated from an inner face by a support thickness, wherein the inner face of two opposing sides is separated by a support diameter, the patch end being physically connected to the bottom face of the conductive patch, the ground plane end comprising a flexible portion having a resilience, wherein the flexible portion is arranged between and connected to the body portion and a footing plate, the footing plate having a footing surface perpendicular to the central axis, the footing surface being dimensioned and arranged to engage a portion of the ground plane, the ground plane end further comprising a mounting plate attached to the inner face of the plurality of sides of the body portion and oriented perpendicular to the central axis, the mounting plate comprising a hole there-through dimensioned and arranged to engage a mounting stud extending from the ground plane and/or a mounting stud protruding therefrom dimensioned and arranged to engage a hole disposed into the ground plane, such that hollow support member is attachable to the ground plane under a preload provided by the resilience of the flexible portion; wherein the hollow support member provides electrical communication between the conductive patch and the ground plane.

In still another aspect of the present invention a patch antenna comprises an array of planar conductive patches, wherein each of the conductive patches is attached to a single ground plane by an individual hollow support member, and a plurality of probe connectors, wherein each of the probe connectors is in electrical communication with at least one of the conductive patches, such that each of the probe connectors conduct electromagnetic energy to or from each of the conductive patches, wherein each of the conductive patches is disposed essentially parallel to the ground plane and is separated from the ground plane by a spacing distance;

wherein each of the hollow support members comprise a plurality of sides disposed about a central axis oriented perpendicular to the conductive patch and the ground plane;

wherein each of the conductive patches is solely supported above the ground plane by the hollow support member; and wherein the hollow support member provides electrical communication between the planer conductive patch and the ground plane.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
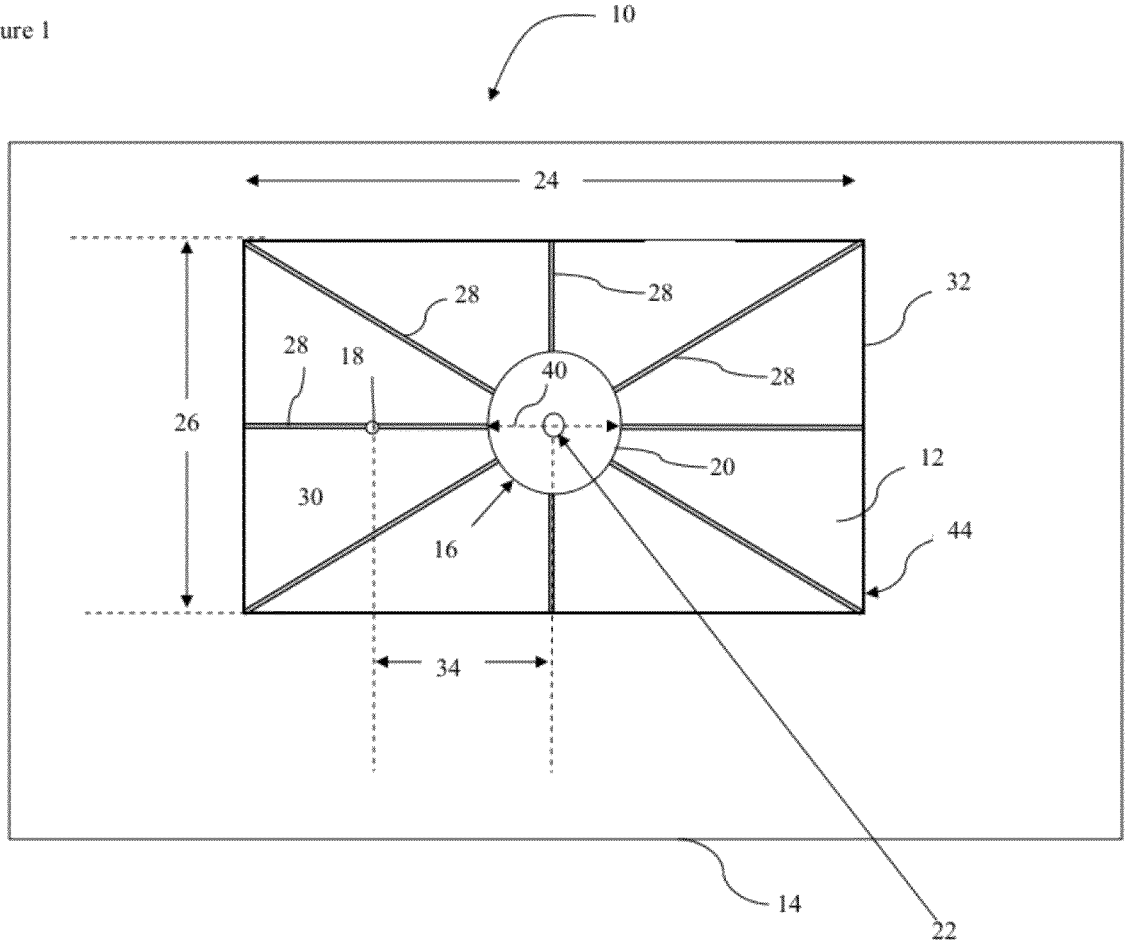
FIG. 1 is a top view of an embodiment of the instant disclosure.

The following detailed description is of the best currently contemplated modes of carrying out the invention. The description is not to be taken in a limiting sense, but is made merely for the purpose of illustrating the general principles of the invention, since the scope of the invention is best defined by the appended claims.

In the following description, numerous specific details are set forth to provide a thorough understanding of the present invention. However, it will be obvious to those skilled in the art that the present invention may be practiced without such specific details. In other instances, well-known devices have been shown in block diagram form in order not to obscure the present invention in unnecessary detail. For the most part, details unnecessary to obtain a complete understanding of the present invention have been omitted in as much as such details are within the skills of persons of ordinary skill in the relevant art.

The instant disclosure provides a patch antenna comprising a planar conductive patch attached to a ground plane by a support member, and a probe connector in electrical communication with the conductive patch arranged to conduct electromagnetic energy to or from the conductive patch. The conductive patch is preferably disposed essentially parallel to the ground plane and is separated from the ground plane by a spacing distance. The support member comprises a plurality of sides disposed about a central axis oriented perpendicular to the conductive patch and the ground plane and may be a column of arbitrary shape. Importantly, the conductive patch of the instant invention is solely supported above the ground plane by the support member. In an embodiment, the support member also provides electrical communication between the planer conductive patch and the ground plane.

In a typical patch antenna, the dimensions of the patch are selected to conform to the intended operation range of the antenna. In an embodiment, the conductive patch may be rectangular having a width and a length. The length (L) is selected to be the intended operational wavelength ($\lambda$) divided by two, i.e., $L=\lambda/2$. The Width (W) is selected to be the length L divided by two, i.e., $W=L/2$. The height (H) of the conductive patch over the ground plane, also referred to herein as the "spacing distance", is preferably selected to be the length (L) divided by ten, i.e., $H=L/10$. In an embodiment, the diameter of the support member is at least twice the spacing distance. The point at which the probe connects to the patch, determined as the distance from the attachment point to the center point of the patch (P), is preferably selected to be the length (L) divided by four, i.e., $P=L/4$.

The operational wavelength of the patch is preferably selected to be at the center frequency of the desired operational band. Accordingly, $\lambda=c/v$, wherein $\lambda$ is in meters, c is the speed of light ($3*10^8$ m/s), and v is the central frequency in He of the desired operational band.

The impedance at the center of a patch antenna element is a short circuit. Applicants have unexpectedly discovered that a wire or post can be connected from the patch to the groundplane at the center point of the patch without impacting radiation performance. In addition, when this connection between the patch and the groundplane is a post, referred to herein as a central support member and/or a center post, the connection can be used to support the patch element, thus eliminating the need for a dielectric in-between the patch and the ground plane for purposes of supporting the patch.

However, in space borne applications, this approach is problematic because a patch element supported by a single thin post is highly susceptible to acoustic loads during launch. It has been discovered that substantial acoustic loads may be tolerated by using a large diameter support member, i.e., a support member having a diameter of at least 5% of the width and/or the length of the conductive patch, preferably a support member having a hollow center post, as the sole supporting structure of the patch.

The instant support member allows for the fabrication of a sufficiently rigid antenna element that can survive launch loads. Additionally, it has been unexpectedly discovered that the instant support member increases the bandwidth of the patch antenna (also referred to herein as the patch or the patch element) without compromising radiation performance.

In an embodiment, the space between the conductive patch and the ground plane is void of any additional material other than the atmosphere in which the patch antenna is located. Accordingly, in a space environment, the space between the conductive patch and the ground plane is the vacuum of space.

In an embodiment, the support member is hollow. In still another embodiment, the support member comprises at least three sides, preferably at least 4 sides, more preferably, at least six sides. In a preferred embodiment, the support member comprises an infinite number of sides (i.e., has a circular cross section), and is hollow. Accordingly, in an embodiment, the support member has a circular cross-section taken perpendicular to a central axis oriented perpendicular to the conductive patch and the ground plane.

In an embodiment, the support member has a diameter, determined from opposing sides through a center point, referred to herein as a support diameter, of at least 5% of the width and/or the length of the conductive patch, more preferably at least 10%, more preferably at least 15%, more preferably at least 20%, more preferably at least 25%, more preferably at least 30%, more preferably at least 35%, more preferably at least 40%, more preferably at least 45%, more preferably at least 50% of the width and/or the length of the conductive patch.

In an embodiment, the conductive patch and the support member are comprised of the same electrically conductive material, preferably any conductive metal, with aluminum, copper, platinum, and alloys comprising aluminum, copper and/or platinum being most preferred. In an embodiment, the conductive patch and the support member are machined and/or otherwise modified from the same piece of conductive material, i.e., from a single piece of metal. This may include casting a piece of metal in the basic form and subsequently machining and/or otherwise modifying the casting to a particular set of specifications, and/or starting with a solid block of metal (e.g., aluminum), and machining and/or otherwise modifying the block to produce the instant patch antenna. In a preferred embodiment, the conductive patch and the support member comprise aluminum.

The conductive patch may have essentially any shape. In an embodiment, at least a portion of the conductive patch comprises a rectangular shape, a circular shape, a square shape, a trapezoidal shape, an oval shape, a triangular shape, a pentagonal shape, a hexagonal shape, an octagonal shape, or any combination thereof. In an embodiment, the conductive patch has a uniform thickness from a center point to an edge of the patch. In yet another embodiment, the thickness of the conductive patch is isotropic from a center point to an edge of the patch. In still another embodiment, the thickness of the conductive patch is anisotropic from a center point to an edge of the patch.

The thickness of the conductive patch depends on the environment in which the antenna is to be used. The conductive patch need only be as thick as required to be entirely supported by the support member, and/or by the support member and a plurality of ribs. The conductive patch is preferably at least 0.01 mm. In a preferred embodiment, the thickness of the conductive patch is greater than or equal to about 0.1 mm, with greater than or equal to about 0.5 mm being more preferred, with greater than or equal to about 1 mm being more preferred, with greater than or equal to about 1.5 mm being more preferred, with greater than or equal to about 2 mm being more preferred, with greater than or equal to about 3 mm being more preferred, with greater than or equal to about 4 mm being more preferred, with greater than or equal to about 5 mm being more preferred, with greater than or equal to about 10 mm being still more preferred.

The conductive patch may further be comprised of a laminate, wherein at least two materials are in contact to form the patch, with the proviso that the side of the patch closest to the ground plane is an electrically conductive material, which is in electrical communication with the ground plane through the support member.

The conductive patch may further comprise a plurality of ribs depending perpendicularly away from a face of the conductive patch opposite the ground plane. In an embodiment, the ribs may extend at least a portion of the way from a center point (e.g., a central axis) to an outer edge of the conductive patch. These ribs may provide support in concert with the support member to further stabilize the conductive patch above the ground plane. The ribs may be directly attached to the face of the conductive patch e.g., welded and/or bonded to the face, and/or may be integral to the conductive patch such that the ribs are produced from the same piece of metal as the conductive patch.

Turning now to the Figures, FIG. 1 shows a top view of an embodiment of a patch antenna according to the instant disclosure, represented generally as 10. Conductive patch 12 is attached to ground plane 14 by a support member 16. A probe connector 18 is in electrical communication with conductive patch 12 at probe connector 18. The point at which probe connector 18 connects to conductive patch 12, is represented by probe distance (P) 34, which is the distance from the attachment point 18 to the central axis 22 of patch 12.

Support member 16 comprises a plurality of sides 20 disposed about a central axis 22 oriented perpendicular to conductive patch 12 and ground plane 14. As shown in the figure, conductive patch 12 is solely supported above ground plane 14 by support member 16.

Conductive patch 12 has a patch length 24 and a patch width 26. Support member 16 has a support diameter 40 which is at least 5% of patch length 24 and/or patch width 26. In an embodiment, support member 16 comprises an electrically conductive material. e.g., a metal, preferably aluminum, and provides electrical communication between conductive patch 12 and ground plane 14.

Figure 2:
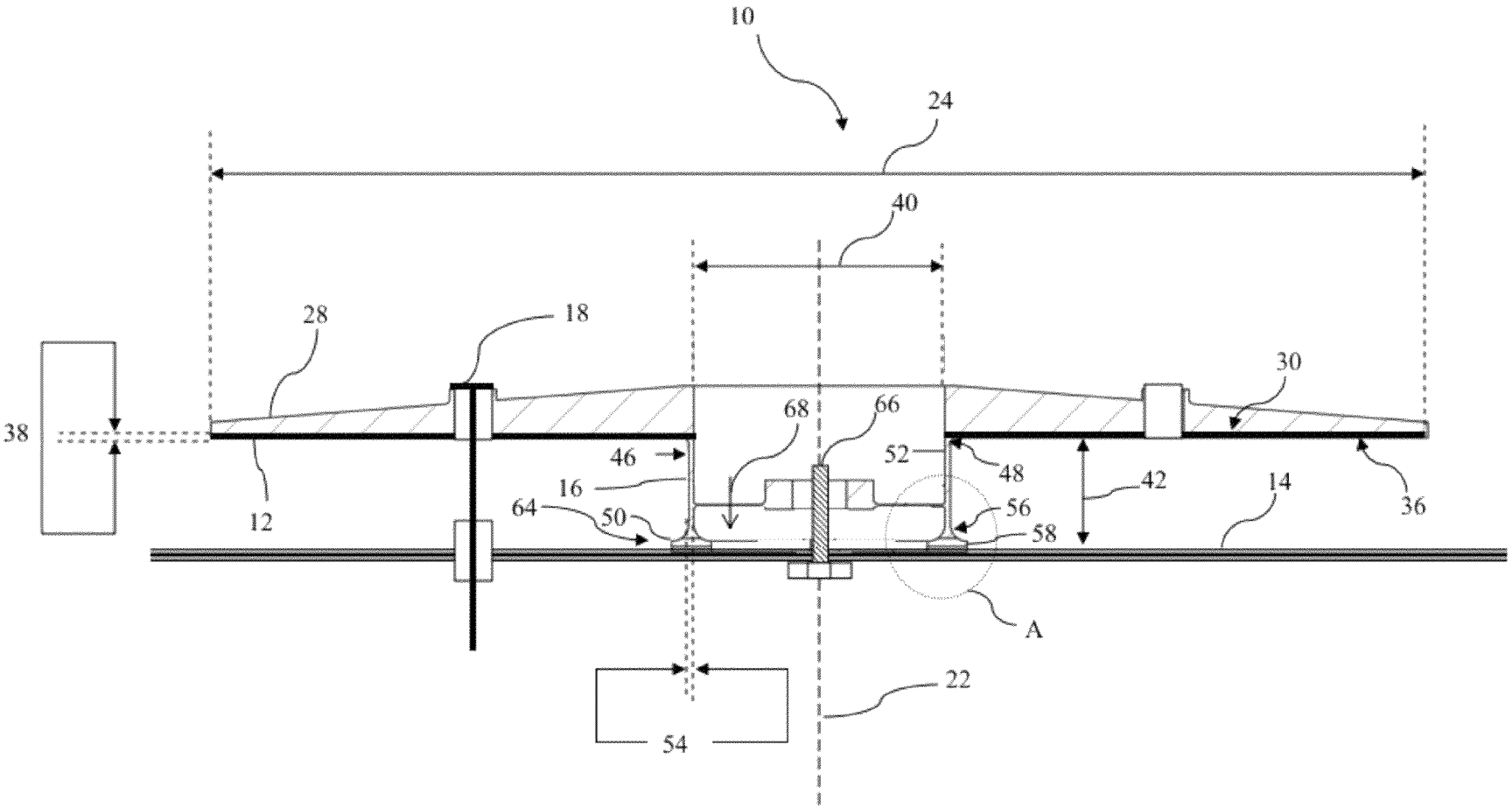
FIG. 2 is a side view of an embodiment of the instant disclosure.

Conductive patch 12 may have a patch top face 30 separated from a patch bottom face 36 separated from each other by a patch thickness 38 (see FIG. 2). Patch top face 30 is located on the side of the patch opposite ground plane 14.

Patch antenna 10 may further include at least one rib 28 depending perpendicularly away from a face, e.g., patch top face 30 and/or patch bottom face 36 of conductive patch 12. In an embodiment, and as shown in FIG. 1, the ribs 28 may extend at least a portion of the way from central axis 22 to an outer edge 32 of conductive patch 12. Ribs 28 are preferably located on patch top face 30 such that patch bottom face 36 is essentially parallel to ground plane 14. Ribs 28 may be attached to the face of conductive patch 12, e.g., top face 30, at least a portion of the length of rib 28 from central axis 22 to outer edge 32, preferably the entire length of rib 28 is attached to and/or in contact with a face of conductive patch 12. In an embodiment, at least one rib 28 is welded to conductive patch 12, adhesively attached to conductive patch 12, secured using a threaded member (not shown) to conductive patch 12, and/or an integral part of conductive patch 12 produced from the same piece of material from which conductive patch 12 was produced, e.g., machined from the same piece of metal. Ribs 28 are preferably comprised of the same material as conductive patch 12, preferably aluminum.

Accordingly, patch antenna 10 may further comprise a plurality of ribs 28 depending perpendicularly away from a face of conductive patch 12, the ribs 28 extending at least a portion of the way from central axis 22 to an outer edge 32 of conductive patch 12.

Figure 3:
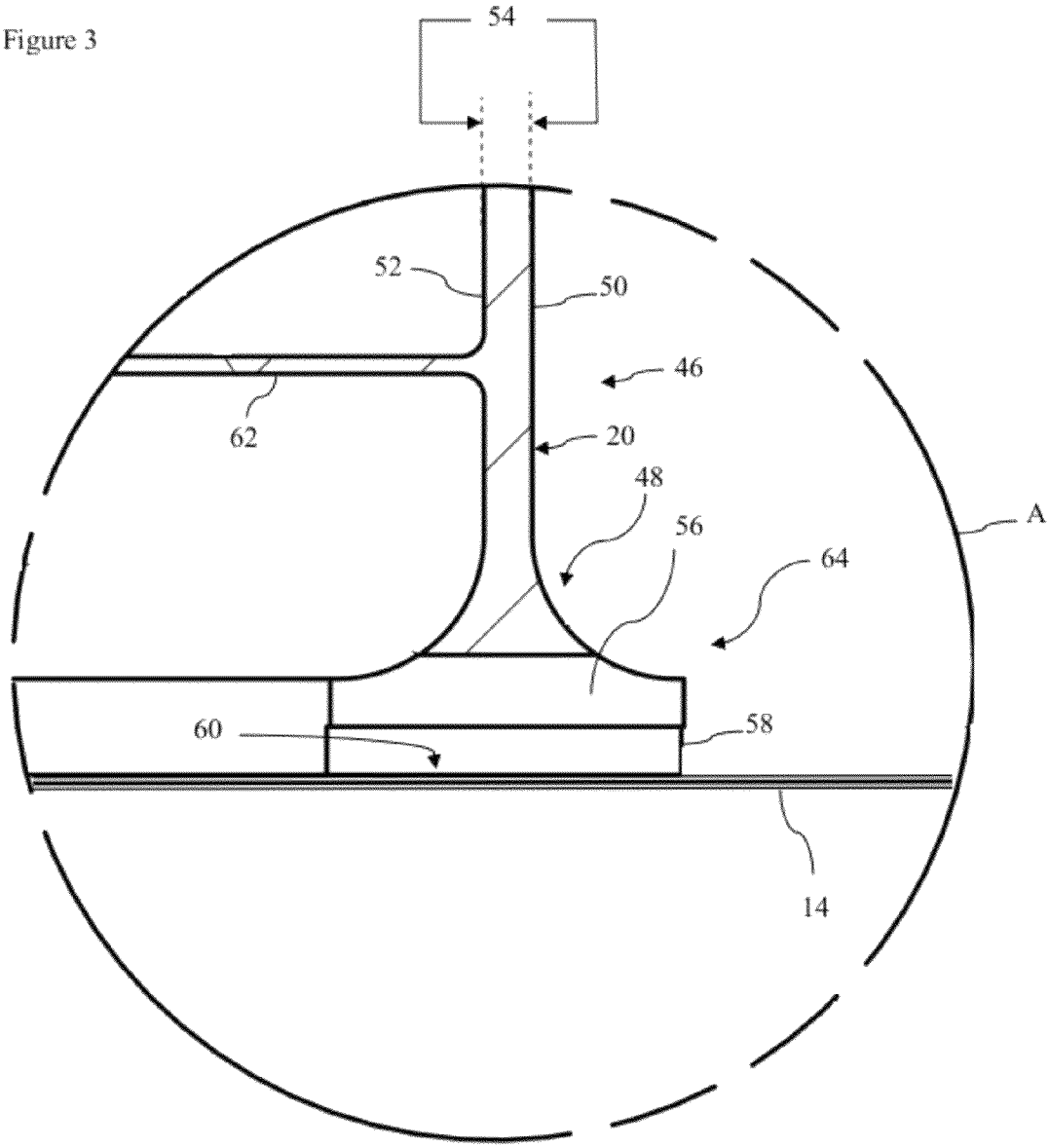
FIG. 3 is an enlargement of Portion A of FIG. 2.

As shown in FIGS. 2 and 3, in an embodiment, support member 16 is hollow and/or has a circular cross-section taken perpendicular to central axis 22. In an embodiment, support member 16 has a support diameter 40 which is at least 5% of the patch width 26 and/or the patch length 24 of conductive patch 12. In an embodiment, support member 16 has at least three sides 20 (i.e., a triangular cross section.) Preferably, support member 16 has a circular cross section and thus comprises an infinite number of sides 20.

In an embodiment, the height of conductive patch 12 over ground plane 14, also referred to herein as spacing distance 42, is void of any additional material other than the atmosphere in which patch antenna 10 is located. Accordingly, in an embodiment, spacing distance 42 does not contain a dielectric material (other than the atmosphere the antenna is located in, if at all). As such, conductive patch 12 is not supported by a dielectric material in spacing distance 42.

In an embodiment of the instant patch antenna 10, conductive patch 12 has a patch shape 44 determined in the plane of conductive patch 12 taken perpendicular to central axis 22. In an embodiment, patch shape 44 comprises a rectangular shape, a circular shape, a square shape, a trapezoidal shape, an oval shape, a triangular shape, a pentagonal shape, a hexagonal shape, an octagonal shape, or any combination thereof. Accordingly, patch shape 44 of conductive patch 12 may comprise essentially any shape as required to effectively operate as required by the intended end use.

In an embodiment, patch antenna 10 comprises planar conductive patch 12 attached to ground plane 14 by a hollow support member 16, and a probe connector 18 in electrical communication conductive patch 12 arranged to conduct electromagnetic energy to or from conductive patch 12. In an embodiment, hollow support member 16 comprises a body portion 46 disposed between a patch end 48 and a ground plane end 64. Body portion 46 comprises a plurality of sides 20 disposed about central axis 22 oriented perpendicular to conductive patch 12 and ground plane 14. In an embodiment, each of the sides 20 has an outer face 50 separated from an inner face 52 by a support thickness 54, wherein inner face 52 of two opposing sides 20 are separated by support diameter 40. In an embodiment, patch end 48 is physically connected to bottom side 36 of conductive patch 12.

As shown in FIG. 3, which is an enlarged view of Detail A in FIG. 2, ground plane end 64 may comprise a flexible portion 56 having a resilience, wherein flexible portion 56 is arranged between and connected to body portion 46 and a footing plate 58; footing plate 58 having a footing surface 60 perpendicular to central axis 22, footing surface 60 being dimensioned and arranged to engage a portion of ground plane 14.

Ground plane end 64 may further comprise a mounting plate 62 attached to inner face 52 of the plurality of sides 20 of body portion 46 and oriented perpendicular to central axis 22. As shown in FIG. 2, mounting plate 62 may comprise a hole there-through dimensioned and arranged to engage a mounting stud 66 extending from ground plane 14 and/or a mounting stud protruding from mounting plate 62 dimensioned and arranged to engage a hole disposed into ground plane 14 (not shown), such that hollow support member 16 attachable to ground plane 14 under a preload force 68 provided by the resilience of flexible portion 56, mounting plate 62, or a combination thereof. In an embodiment, flexible portion 56 is comprised of the same material as hollow support member 16, and/or is machined into one or more sides 20 of hollow support member 16 such that hollow support member 16 provides electrical communication between conductive patch 12 and ground plane 14.

Figure 4:
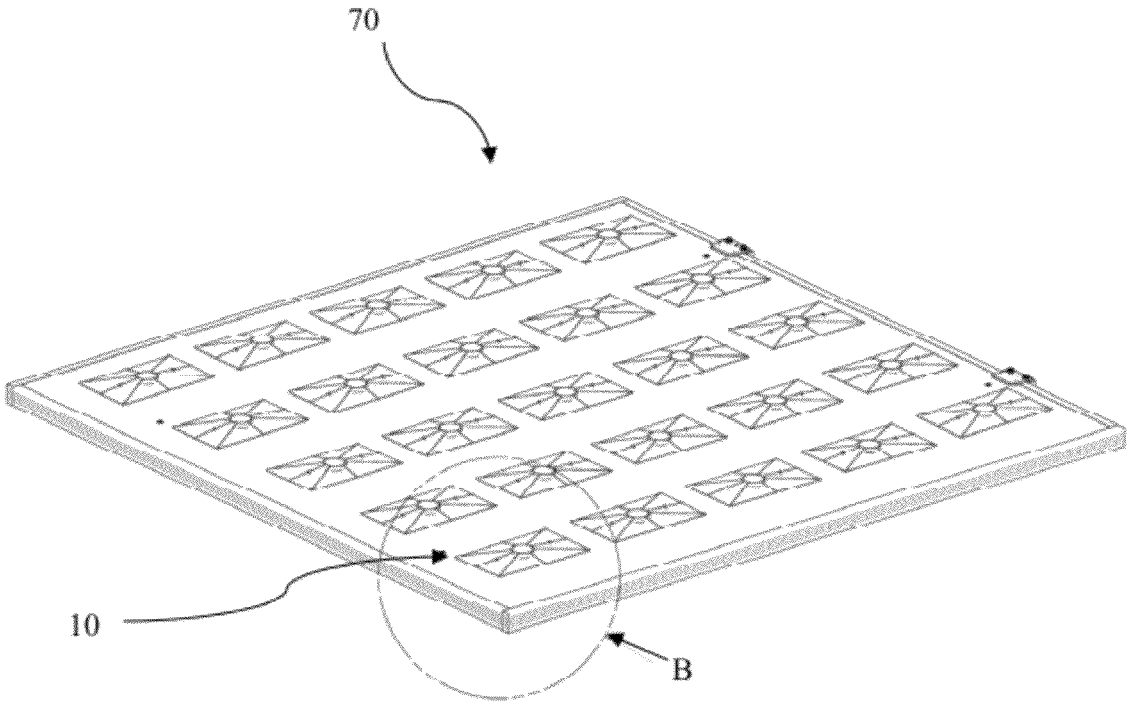
FIG. 4 is an antenna array of the antenna of the instant disclosure.
Figure 5:
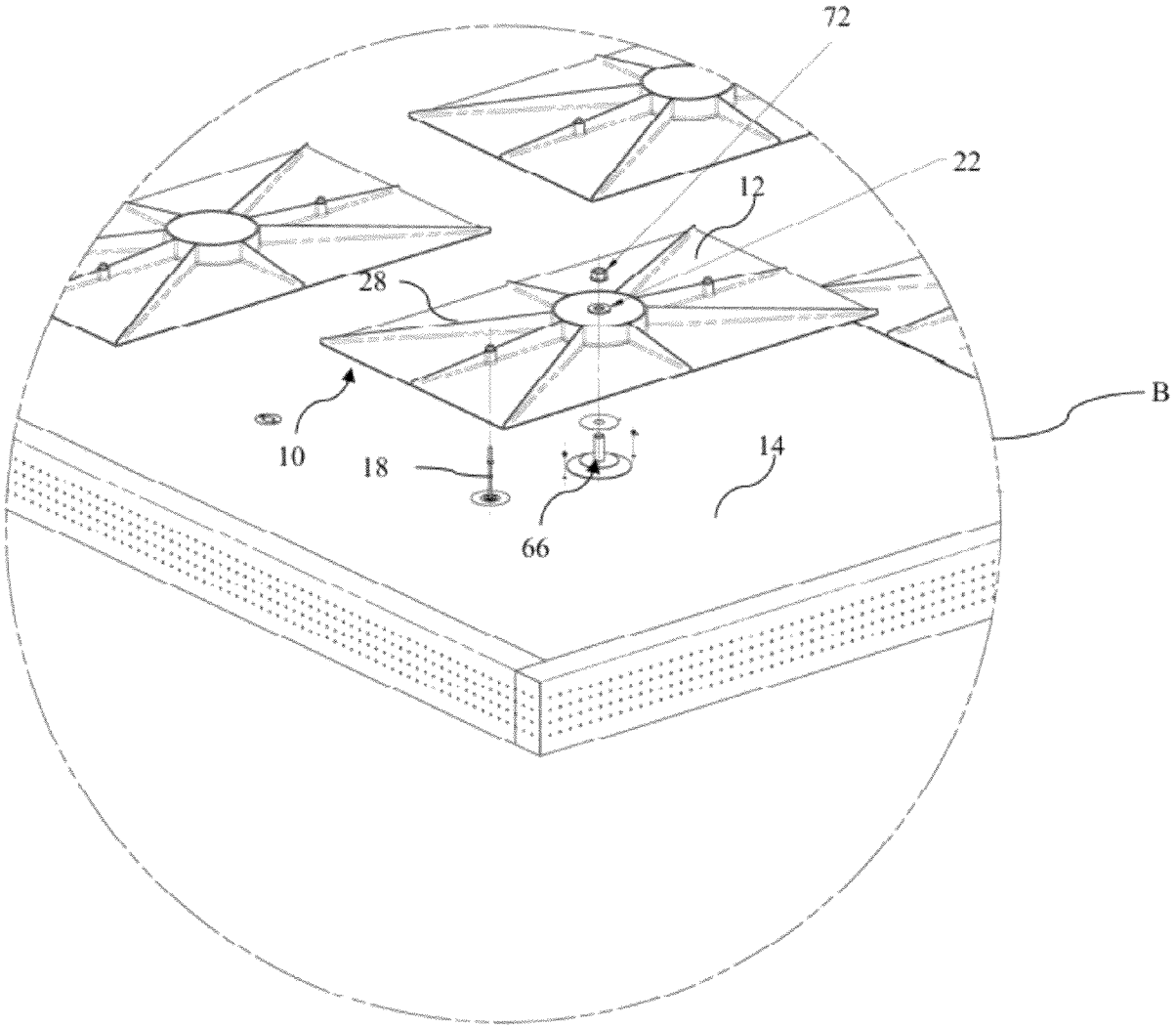
FIG. 5 is an enlargement of Portion B of FIG. 4.
Figure 6:
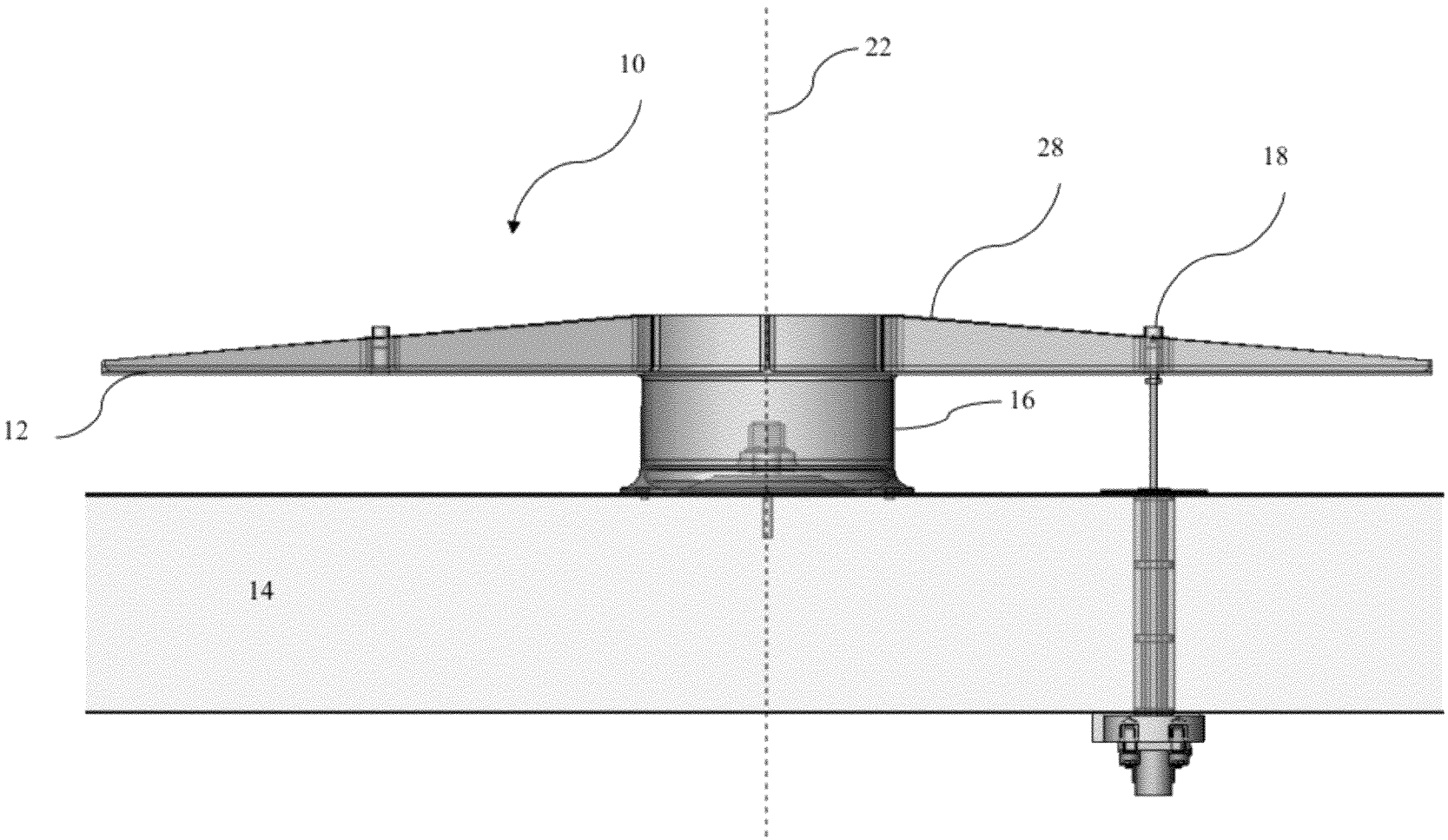
FIG. 6 is a partial cutaway side view of an embodiment of the instant disclosure.

In an embodiment, as shown in FIGS. 4 through 6, patch antenna 10 of the instant disclosure may be included in an antenna array 70 comprising a plurality of planar conductive patches 12, wherein each of the conductive patches is attached to a single ground plane 14 by an individual support member 16, and a plurality of probe connectors 18, wherein each of the probe connectors 18 is in electrical communication with at least one of the conductive patches 12, such that each of the probe connectors 18 conduct electromagnetic energy to or from each of the conductive patches 12.

As shown in FIG. 5, each of the conductive patches 12 may be connected to ground plane 14 using a threaded mounting stud 66 and a corresponding threaded nut 72.

FIG. 6 depicts a patch antenna of the instant disclosure showing a partial cut-away view of the probe connector disposed through the base plane, and the patch attached under preload to the base plane by a mounting stud.

In an embodiment, the instant patch antenna may be included in a stacked antenna design (not shown), wherein a first conductive patch is attached through a first support member over a ground plane; and a second conductive patch is attached through a second support member over the top side of the first conductive patch such that the top side of the first conductive patch serves as coupling mechanism to the second patch. The stacked antenna design is not limited to two conductive patches, and may thus include a plurality of conductive patches; each stacked one on top of the other as described herein such that the top side of the bottom conductive patch serves as the ground plane for the conductive patch on top of the bottom conductive patch. In an embodiment, each of the conductive patches may be in electrical communication with, and provided electromagnetic radiation through a common probe connector, and/or each may be provided with electromagnetic radiation via an individual probe connector. In an embodiment, at least one, and preferably each of the conductive patches are in electrical communication with the ground plane through the individual support members.

Accordingly, in an embodiment, a stacked patch antenna comprises a plurality of the planar conductive patches as described herein, arranged in a stacked configuration such that a first conductive patch is attached to the ground plane by a first support member, and the probe connector in electrical communication with the first conductive patch is arranged to conduct electromagnetic energy to or from the first conductive patch, wherein the first conductive patch is solely supported above the ground plane by the first support member; wherein the first support member provides electrical communication between the first planer conductive patch and the ground plane; wherein at least one additional conductive patch is attached through a second support member over a top side of the first conductive patch such that the top side of the first conductive patch serves as the second ground plane to the at least one additional conductive patch, wherein the second conductive patch is solely supported above the first conductive patch by the second support member; and wherein the second conductive patch is in electrical communication with the ground plane through the second support member, the first conductive patch, and the first support member.

In another embodiment, the stacked patch antenna comprises a plurality of conductive patches, each stacked one on top of the other such that the top side of a lower conductive patch serves as the ground plane for the upper conductive patch located directly on top of the lower conductive patch.

In yet another embodiment, the stacked patch antenna comprises at least one of the plurality of conductive patches which is in electrical communication with, and provided electromagnetic radiation through a common probe connector in electrical communication with at least one other conductive patch, and/or at least one of the plurality of conductive patches which is in electrical communication with, and provided electromagnetic radiation through an isolated probe connector which is not in electrical communication with at least one other conductive patch. Any combination of isolated and/or common probe connectors may be used.

In an embodiment, the patch antenna comprising the conductive patch and support member are envisioned as being fabricated (e.g., milled) from a single piece of metal, preferably aluminum. Alternately, the conductive patch and support member may be fabricated separately and then joined using fasteners, adhesive, bonding, and/or welding. The corresponding patch structure may then be bonded and/or fastened to the groundplane. Patch antennas may be fed in a number of different ways including a design wherein probe connector is fed from a coaxial connector attached to the backside of a supporting groundplane. The probe can be either soldered to the patch or attached by means of a slip-lit connector assembly in the patch. The latter approach provides stress relief for the probe attachment during vibrational events, e.g., launch of a spacecraft. The thickness of the conductive patch, the conductive patch material, the interconnect technique, and the attachment technique of the patch to the support member and/or the groundplane will necessarily depend on the intended end use, e.g., of individual mass and lunch load requirements for use in a space craft. Arrays of patch elements can be fabricated by attaching several structures to a common groundplane/support structure.

This instant patch antenna accomplishes the purpose of eliminating dielectric from the patch radiating element, a large-diameter ground post could be added to dielectric-based patch designs to increase bandwidth without having to add extra radiating layers. The preferred all-metal design disclosed herein further eliminates the use of dielectric in the various patch antenna components making it suitable to environments with high electrostatic discharge (ESD) susceptibility. Elimination of dielectric also makes the tuning of the element independent of material properties (principally permittivity). In addition, the instant all-metal patch design is robust enough to survive typical launch loads and other intense vibrational environments.

Additionally, a large diameter central support member with a rectangular shaped patch has unexpectedly been shown to increase the bandwidth of the patch antenna up to at least 5%, preferably 10%, more preferably at least about 20% or more without significantly affecting the radiation pattern performance of the antenna. Typically, a stacked patch design is used to obtain an impedance bandwidth of 20% or more. In addition the instant single-layer patch antenna may be designed with various non-uniform geometries (e.g., such as an "E" shape, a Cross shape, and the like,) which unlike designs previously reported in the literature, do not suffer from poor cross polarization performance. Accordingly, in addition to the other benefits described herein, the instant patch antenna further results in an unexpected improvement in a reduction of cross-polarization (an increased cross-polarization suppression of greater than or equal to about 5 db, preferably greater than or equal to about 10 db, preferably greater than or equal to about 20 db, preferably greater than or equal to about 30 db, preferably greater than or equal to about 40 db, preferably greater than or equal to about 50 db, preferably greater than or equal to about 60 db, preferably greater than or equal to about 70 db, preferably greater than or equal to about 80 db, preferably greater than or equal to about 90 db, preferably greater than or equal to about 100 db over known patch antenna. Without wishing to be bound by theory, this unexpected benefit is believed to be due, at least in part from, the symmetry of the design. The elimination of substrate dielectric further simplifies the design and modeling processes because material properties are essentially eliminated from the tuning process. Concurrence between measurements and modeling is thus driven by the fidelity of the modeling software and fabrication tolerances (as opposed to material properties).

The instant patch antenna element has numerous potential uses on various spacecraft and other uses, especially end uses wherein a dielectric is undesirable or where wide bandwidth is required in a single-layer element. The double-tuned nature of the element makes it suitable for communications applications where transmission and reception are required at adjacent frequencies through a common radiating structure.

EXAMPLES

To further evaluate the instant patch design, embodiments of the instant design were subjected to thermal testing and vibrational testing. These data were collected by measuring the reflection coefficient at the antenna input using a vector network analyzer. The data were taken outdoors to minimize reflections. The theoretical results were obtained from an industry-standard electromagnetic software simulator HFSS. HFSS is a commercial finite element method solver for electromagnetic structures from Ansoft Corporation (Pittsburgh, Pa., USA). The acronym HFSS stands for high frequency structural simulator. It is one of the most popular and powerful applications used for antenna design and the design of complex RF electronic circuit elements including filters, transmission lines, and packaging. It was originally developed by Professor Zoltan Cendes, his brother Nicholas Csendes, and his students at Carnegie Mellon University. HFSS is universally known to one of minimal skill in the art and thus is not elaborated on further.

Figure 7:
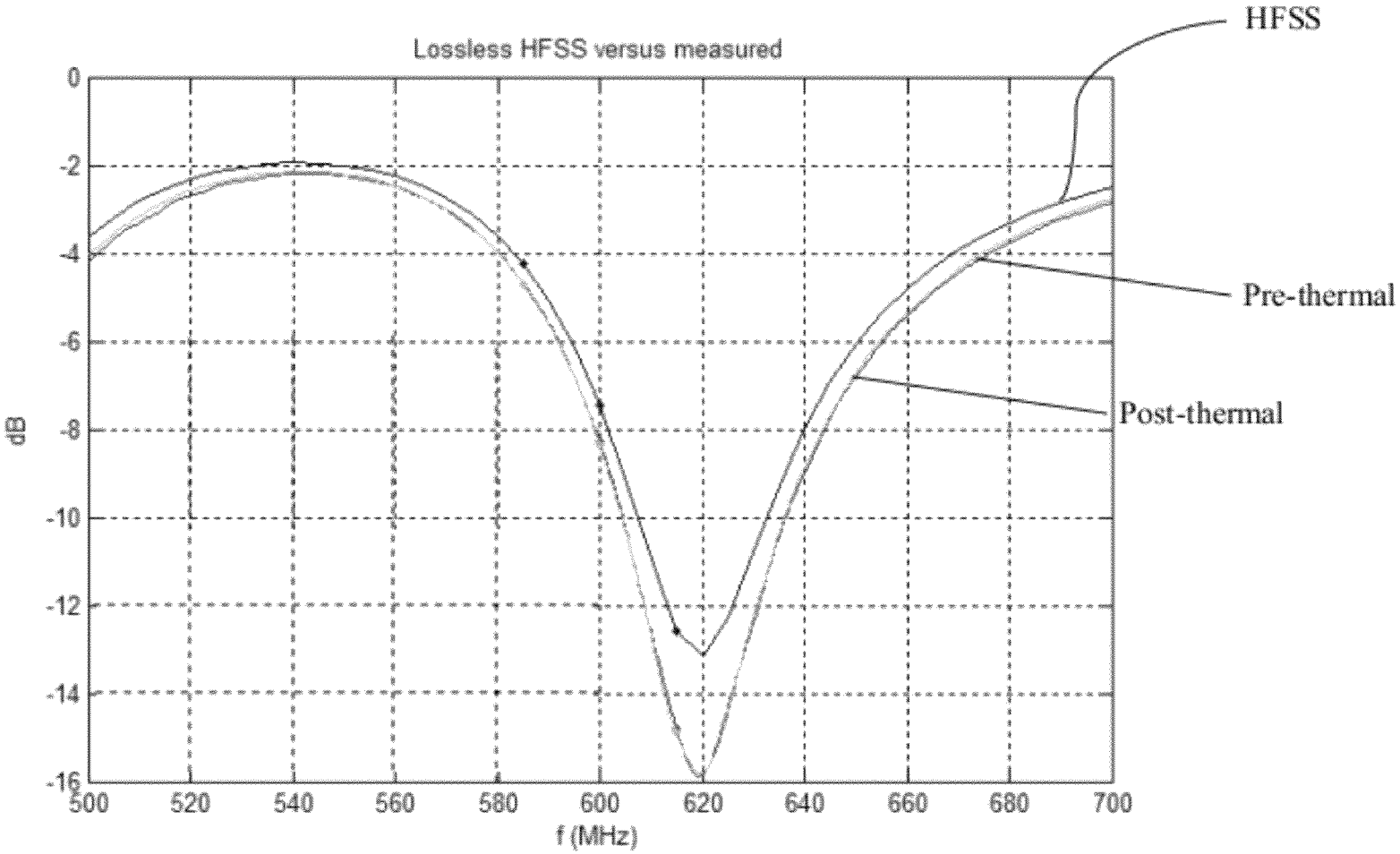
FIG. 7 is a graphical representation of thermal testing of an antenna of the instant disclosure.

The thermal testing was conducted from −135° C. to 120° C. using 3 cycles and 1 hour dwell times. No detachment of the mounting stud from the ground plane was observed and no appearance of damage to the antenna was observed over the duration of the testing. The return loss was very close to the pre-thermal measurements, indicating essentially no hysteresis. The measured frequency tuning agrees the HFSS model to within 0.01%, which is in contrast to previously reported antenna which utilize a dielectric element, wherein the best agreement between the HFSS model and the prior art antenna obtained was about 1% or greater. The results of the thermal testing are shown in graphical format in FIG. 7. As the data shows, the pre-thermal testing results are essentially identical to the post-thermal testing results.

Figure 8:
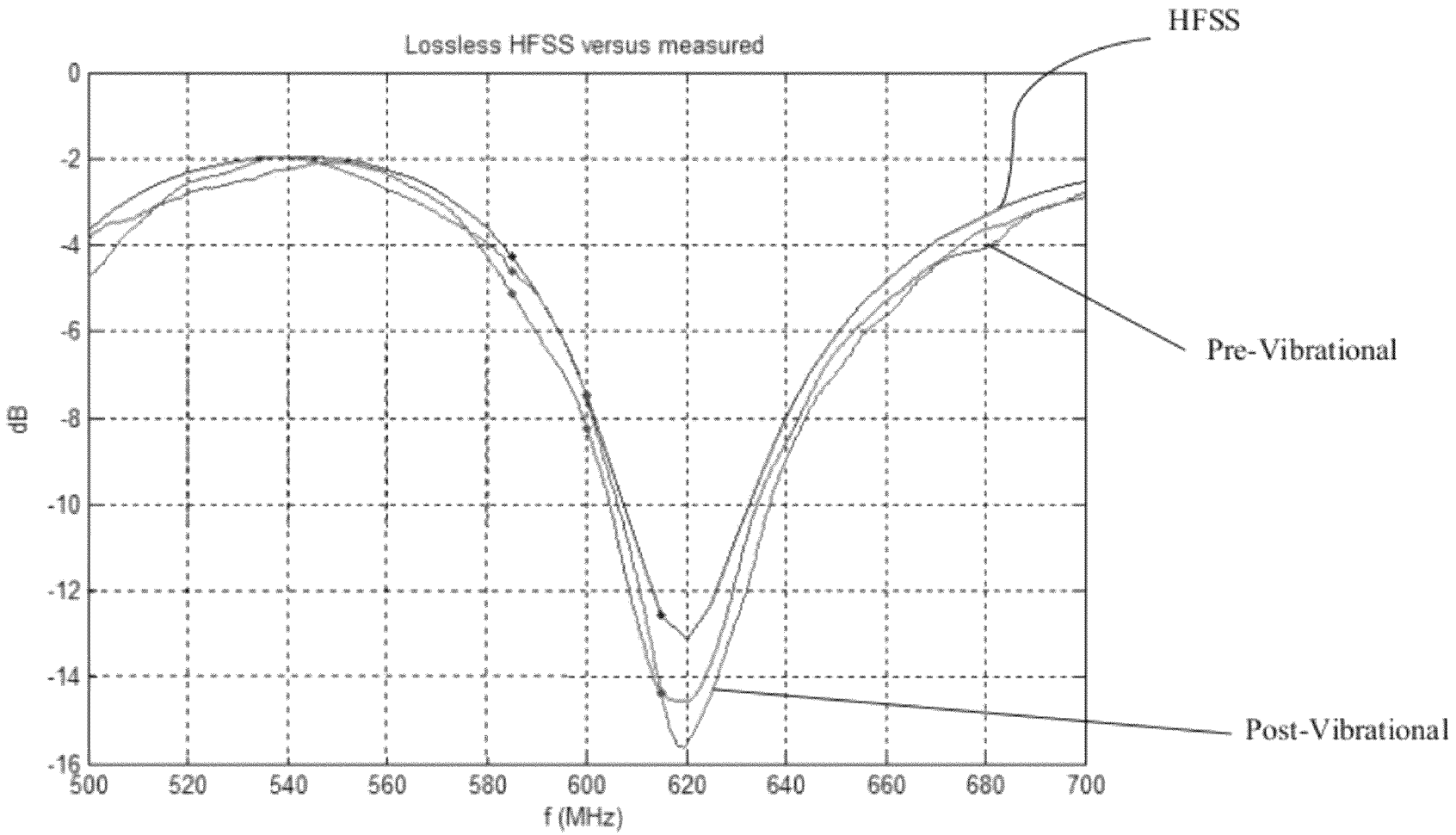
FIG. 8 is a graphical representation of vibrational testing of an antenna of the instant disclosure.

Vibrational testing was conducted using 40 g Z-axis, 20 g X and Y axis with a 60 second duration. The vibrational frequency shifts of the instant antenna were less than 5%. No structural failures were observed and no signs of abrasion of the probe were observed after the testing. The return loss measurements agree within room reflection error with the pre-vibration testing results. The results of the vibrational testing are shown in graphical format in FIG. 8.

From a frequency point of view, the measured and modeled curves align to within 0.2 MHz, or about 0.03%. This is very good alignment compared to the performance obtained from patches printed on dielectric substrates. For example, compared to a comparative antenna having a dielectric substrate, e.g., a Rogers 4003 dielectric, which is a well know high quality RF dielectric substrate having a permittivity of 3.55+/−0.05 as published in their literature. The uncertainty of 0.05 is 1.4% of the nominal value, so the frequency uncertainty, which is proportional to the square root of the frequency, will be +/−0.7%. By comparison, the instant metal patch antenna frequency is more than 20 times more accurate than a comparative antenna using a Roger's 4003 dielectric substrate.

In practice, there may be other uncertainties (such as anisotropy, changes with temperature and aging) that further increase the performance difference. For example, a comparative patch printed on Rogers 4003 will experience a change in resonant frequency by about 0.3% to 0.4% when the temperature changes by 100° C. whereas the metal patch frequency of the instant disclosure is fixed by the coefficient of thermal expansion of the material it is manufactured from. For aluminum, this would be 0.24%, for iron this would be 0.12%. Anisotropy in Rogers 4003 can lead to errors on the order of 2% and is difficult to model. Other dielectric substrates may have even larger variations. In contrast, the instant conductive patch is relatively easy to model because the artisan need only pay attention to the geometry, i.e., the shape of the conductive patch. The patch metal has almost no impact on the tuning of the element as long as the conductive patch is a good conductor i.e., a metal like copper, aluminum, iron, gold, and the like, of which there are many to choose from including all of Groups 1-16 of the Periodic Table of the Elements, which are characterized as metals are suitable for use herein, depending on the end use conditions.

From an amplitude point of view the measured reflection coefficient agrees with the theory to within about 10%. This is a marked improvement over other antenna known in the art, especially in view of the difficulties involved in making these kinds of comparisons, which include the inherent difficulty to model antenna loss and the affects thereof on the reflection coefficient and/or the highly-sensitive nature of the reflection coefficient which is both difficult to model and measure, especially at low values. Adding synthetic loss to the HFSS model data, the instant antenna may result in two sets of measurements to agree to within 5%. The residual error in the measurements may properly be attributed to a mixture of modeling and measurement uncertainties. Overall, the instant antenna provides an improvement in agreement in the character of the measured and modeled data over the prior art.

It should be understood, of course, that the foregoing relates to preferred embodiments of the invention and that modifications may be made without departing from the spirit and scope of the invention as set forth in the following claims.

The invention claimed is:

1. A patch antenna comprising a planar conductive patch attached to a ground plane by a support member, and a probe connector in electrical communication with the conductive patch arranged to conduct electromagnetic energy to or from the conductive patch, wherein the conductive patch is disposed essentially parallel to the ground plane and is separated from the ground plane by a spacing distance;

wherein the support member comprises a plurality of sides disposed about a central axis oriented perpendicular to the conductive patch and the ground plane, wherein the conductive patch is solely supported above the ground plane by the support member and the spacing distance is void of a dielectric layer; and wherein the support member provides electrical communication between the planer conductive patch and the ground plane.

2. The patch antenna of claim 1, wherein the conductive patch and the support member are comprised of the same electrically conductive material.

3. The patch antenna of claim 1, wherein the conductive patch and the support member comprise aluminum.

4. The patch antenna of claim 1, wherein the space between the conductive patch and the ground plane is void of any additional material other than the atmosphere in which the patch antenna is located.

5. The patch antenna of claim 1, wherein the support member is hollow and comprises at least three sides.

6. The patch antenna of claim 1, wherein the conductive patch further comprises a plurality of ribs depending perpendicularly away from a face of the conductive patch, the ribs extending at least a portion of the way from the central axis to an outer edge of the conductive patch.

7. The patch antenna of claim 1, wherein the support member has a circular cross-section taken perpendicular to the central axis.

8. The patch antenna of claim 1, wherein at least a portion of the conductive patch comprises a rectangular shape, a circular shape, a square shape, a trapezoidal shape, an oval shape, a triangular shape, a pentagonal shape, a hexagonal shape, an octagonal shape, or any combination thereof.

9. The patch antenna of claim 1 wherein the support member has a support diameter of at least 5% of the width and/or the length of the conductive patch.

10. A patch antenna comprising a planar conductive patch attached to a ground plane by a hollow support member, and a probe connector in electrical communication with the conductive patch arranged to conduct electromagnetic energy to or from the conductive patch;

wherein the conductive patch has a patch top face separated from a patch bottom face by a patch thickness, wherein the patch bottom face is disposed essentially parallel to the ground plane and is separated from the ground plane by a spacing distance;

wherein the hollow support member comprises a body portion disposed between a patch end and a ground plane end;

the body portion comprising a plurality of sides disposed about a central axis oriented perpendicular to the conductive patch and the ground plane, each of the sides having an outer face separated from an inner face by a support thickness, wherein the inner face of two opposing sides is separated by a support diameter, the patch end being physically connected to the bottom side of the conductive patch, the ground plane end comprising a flexible portion having a resilience, wherein the flexible portion is arranged between and connected to the body portion and a footing plate, the footing plate having a footing surface perpendicular to the central axis, the footing surface being dimensioned and arranged to engage a portion of the ground plane, the ground plane end further comprising a mounting plate attached to the inner face of the plurality of sides of the body portion and oriented perpendicular to the central axis, the mounting plate comprising a hole there-through dimensioned and arranged to engage a mounting stud extending from the ground plane and/or a mounting stud protruding therefrom dimensioned and arranged to engage a hole disposed into the ground plane, such that hollow support member is attachable to the ground plane under a preload force provided by the resilience of the flexible portion, the mounting plate, or a combination thereof;

wherein the hollow support member provides electrical communication between the conductive patch and the ground plane.

11. The patch antenna of claim 10, wherein the conductive patch and the hollow support member are comprised of the same electrically conductive material.

12. The patch antenna of claim 10, wherein the conductive patch and the hollow support member are comprised of aluminum or an aluminum alloy.

13. The patch antenna of claim 10, wherein the space between the conductive patch and the ground plane is void of any additional material other than the atmosphere in which the patch antenna is located.

14. The patch antenna of claim 10, wherein the hollow support member comprises at least three sides.

15. The patch antenna of claim 10, wherein the conductive patch further comprises a plurality of ribs depending perpendicularly away from the top face of the conductive patch, the ribs extending at least a portion of the way from the central axis to an outer edge of the conductive patch.

16. The patch antenna of claim 10, wherein the hollow support member has a circular cross-section taken perpendicular to the central axis.

17. The patch antenna of claim 10, wherein at least a portion of the conductive patch comprises a rectangular shape, a circular shape, a square shape, a trapezoidal shape, an oval shape, a triangular shape, a pentagonal shape, a hexagonal shape, an octagonal shape, or any combination thereof.

18. The patch antenna of claim 10 wherein the support diameter is at least 5% of the width and/or the length of a portion of the conductive patch.

19. A patch antenna comprising an array of planar conductive patches, wherein each of the conductive patches is attached to a single ground plane by an individual support member, and a plurality of probe connectors, wherein each of the probe connectors is in electrical communication with at least one of the conductive patches, such that each of the probe connectors conduct electromagnetic energy to or from each of the conductive patches, wherein each of the conductive patches is disposed essentially parallel to the ground plane and is separated from the ground plane by a spacing distance;

wherein each of the support members comprise a plurality of sides disposed about a central axis oriented perpendicular to the conductive patch and the ground plane;

wherein each of the conductive patches is solely supported above the ground plane by the support member and the spacing distance is void of a dielectric laser; and wherein the support member provides electrical communication between the planer conductive patch and the ground plane.

20. The patch antenna of claim 19, wherein each of the conductive patches and each of the support members comprise aluminum.

21. A stacked patch antenna comprising a plurality of the planar conductive patches of claim 1 arranged in a stacked configuration such that a first conductive patch is attached to the ground plane by a first support member, and the probe connector in electrical communication with the first conductive patch is arranged to conduct electromagnetic energy to or from the first conductive patch, wherein the first conductive patch is solely supported above the ground plane by the first support member;

wherein the first support member provides electrical communication between the first planer conductive patch and the ground plane;

wherein at least one additional conductive patch is attached through a second support member over a top side of the first conductive patch such that the top side of the first conductive patch serves as the second ground plane to the at least one additional conductive patch, wherein the second conductive patch is solely supported above the first conductive patch by the second support member; and wherein the second conductive patch is in electrical communication with the ground plane through the second support member, the first conductive patch, and the first support member.

22. The stacked patch antenna of claim 21, wherein a plurality of conductive patches are each stacked one on top of the other such that the top side of a lower conductive patch serves as the ground plane for the upper conductive patch located directly on top of the lower conductive patch.

23. The stacked patch antenna of claim 21, wherein at least one of the plurality of conductive patches is in electrical communication with, and provided electromagnetic radiation through a common probe connector in electrical communication with at least one other conductive patch, wherein at least one of the plurality of conductive patches is in electrical communication with, and provided electromagnetic radiation through an isolated probe connector which is not in electrical communication with at least one other conductive patch, or a combination of thereof.

* * * * *